US006681400B1

(12) United States Patent
Mills

(10) Patent No.: US 6,681,400 B1
(45) Date of Patent: Jan. 27, 2004

(54) DUAL USE BODY ARMOR

(76) Inventor: Craig A. Mills, 16810 SW. 79th Pl., Miami, FL (US) 33157

( * ) Notice: Subject to any disclaimer, the term of this patent is extended or adjusted under 35 U.S.C. 154(b) by 0 days.

(21) Appl. No.: 10/292,940

(22) Filed: Nov. 13, 2002

(51) Int. Cl.[7] ..... F41H 1/02; A41H 5/00
(52) U.S. Cl. ..... 2/2.5; 89/36.01
(58) Field of Search ..... 2/2.5, 94, 102, 2/69, 463–465, 108; 224/577, 578, 586, 625, 683; 383/4; 89/36.01, 36.02

(56) References Cited

U.S. PATENT DOCUMENTS

| | | | | | |
|---|---|---|---|---|---|
| 1,398,682 | A | * | 11/1921 | Dragic et al. | 2/2.5 |
| 3,783,449 | A | * | 1/1974 | Davis | 2/2.5 |
| 4,475,247 | A | * | 10/1984 | Lee | 2/2.5 |
| 4,637,076 | A | * | 1/1987 | Tartt et al. | 2/102 |
| 5,031,733 | A | * | 7/1991 | Chang | 190/1 |
| 5,060,314 | A | * | 10/1991 | Lewis | 2/2.5 |
| 5,771,489 | A | * | 6/1998 | Snedeker | 2/2.5 |
| 5,797,140 | A | * | 8/1998 | Davis et al. | 2/2.5 |
| 5,829,653 | A | * | 11/1998 | Kaiser | 224/577 |

* cited by examiner

*Primary Examiner*—Tejash Patel
(74) *Attorney, Agent, or Firm*—Robert J. Van Der Wall

(57) ABSTRACT

There is provided dual use body armor that can be alternately used either as a hand held shield which can be concealed in a standard bag (such as an attache case) or worn as an armor vest, and which can be quickly converted from one use to the other. For this reason the shield would normally be of an approximately rectangular shape. The exact shape may be varied in order to fit in different types of carry bag, or to better conform (for the purpose of comfort or protection) to the shape of the body when unstowed or deployed and worn as a vest. When used as a vest, the invention is preferably comprised of two or more armor panels that unfold or deploy to protect an area of the front and back, and preferably also the side and lower abdomen, of the torso. The front armor panel, back armor panel, side armor panels, and lower abdomen armor panel, are all located on the body by means of a support system. When stowed, the side and lower abdomen armor panels are shaped to fit closely together as in a jigsaw puzzle as the middle layer of a three layer structure. The armor is designed to be unstowed and put on as a vest with no need for fastening or adjustment.

19 Claims, 3 Drawing Sheets

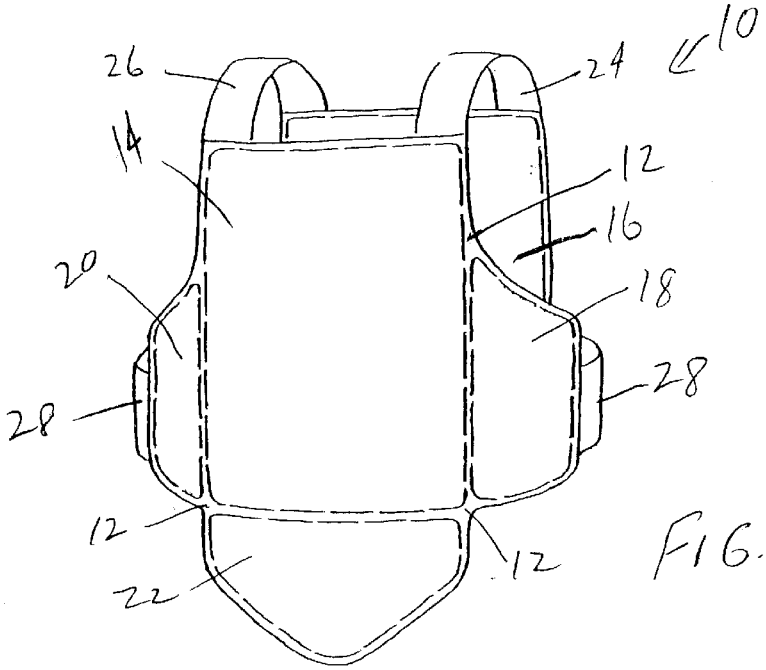
FIG. 1
FIG. 2
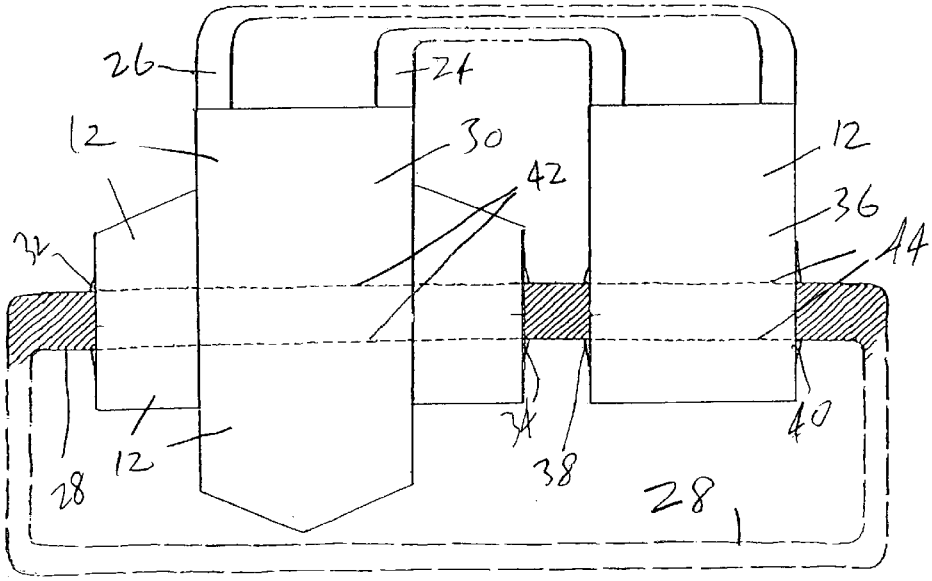

DUAL USE BODY ARMOR

BACKGROUND OF THE INVENTION

1. Field of the Invention

The present invention relates generally to the field of body armor and specifically concerns body armor apparatus that has been designed to be used in either of two ways. It is designed to be used as a hand-held shield (independently, or in the user's own attache case or carrying bag) or it can be quickly donned and worn as an armor vest. The two main options available to a person requiring covert body armor are (a) to wear a concealed armor vest, or (b) carry a disguised hand held shield.

2. Description of the Prior Art it is well known to attempt to protect the human body from bullets by garments resistant to bullet penetration. Such devices used to be referred to as "bullet proof vests" although modern weaponry has rendered that terminology overly optimistic. There are literally hundreds of issued patents relating to this technology, now often referred to as body armor. A few examples of this prior art are Colvin, U.S. Pat. No. 6,418,832, Zufle, U.S. Pat. No. 4,535,478, Rudoi, U.S. Pat. No. 4,633,756, and Herbert, U.S. Pat. No. 4,467,476.

A standard protective shield of the type and size that could be carried or concealed in an attache case (or other hand-held bag) can only be used to protect one chosen side of the body. It also has to be held against the body or positioned away from the body by hand. The usefulness of such an item is limited by the fact that a potential assailant might eventually (if not immediately) realize that there is a shield concealed in or disguised within the attache case or carrying bag.

Unless the risk of attack is very high, it is unlikely that a person will decide to constantly wear an armor vest. There are comfort and other practical disadvantages to wearing concealed body armor for extended periods of time or during normal routine circumstances. A person who is aware of some chance that they might need protection is more likely to prefer having a vest available for use as and when required. An armor vest is of no immediate use if it is not immediately available, and is no use at all if it is inaccessible or can not be donned during threatening circumstances.

SUMMARY OF THE INVENTION

Bearing in mind the foregoing, it is a principal object of the present invention to provide body armor that can be alternately used either as a hand held shield or worn as an armor vest.

It is another object of the present invention to provide such body armor that can be quickly converted from one use to the other, depending upon circumstances, and according to the user's needs.

It is related object of the present invention that when the same is converted from use as a shield to use as a vest, no superfluous parts remain.

A further object of the invention is that the converted shield bears no resemblance to anything but a regular body armor vest.

An additional object of the invention is that when stowed for use as a shield, the invention or compacts to a size and shape designed to be inserted into a standard carrying bag such as an attache case, wherein it may be disguised.

A related object of the invention is to vacuum pack the folded body armor in a semi-rigid pouch that is preferably made from plastic.

Other objects and advantages will become apparent to those skilled in the art upon reference to the following descriptions and the appended drawings.

In accordance with a principal aspect of the invention there is provided dual purpose body armor that can be alternately used either as a hand held shield or worn as an armor vest and which can be quickly converted from one use to the other. For this reason the shield would normally be of an approximately rectangular shape. The exact shape may be varied in order to fit in different types of carry bag, or to better conform (for the purpose of comfort or protection) to the shape of the body when unstowed or deployed and worn as a vest.

In accordance with another aspect of the invention, when used as a vest, the invention is preferably comprised of two or more armor panels that unfold or deploy to protect an area of the front and back, and preferably also the side, of the torso that is larger than the area of the stowed panels. The front armor panel, back armor panel, side armor panels, and lower abdomen armor panel, are all located on the body by means of a support system. Alternatively, there are two armor panels, one to protect the front and one to protect the back of the torso, both located on the body by means of a support system. The simplest alternative is a single armor panel that is worn to protect the front of the torso, located on the body by means of a support system.

In each embodiment where several armor panels unfold or deploy to protect a larger area of the body, the panels are attached or configured in such a way that the bulk and thickness of the stowed shield is minimised. This way the stowed shield is more easily carried and concealed within the attache or other carrying case, leaving more room within which to carry other items for which the case is intended. This method of configuring individual panels within a stowed shield is also intended to provide a more consistent level of protection over the area of the shield prior to unfolding or deployment. This is achieved by shaping the individual panels so that they fit closely together when stowed or folded, as in a simple jigsaw puzzle, leaving minimal gaps between the individual panels. This form accommodates well to vacuum packing the folded body armor in a semi-rigid pouch that is preferably made from plastic.

The multiple armor panels comprise individual panels that are either "fixed", "floating", or a combination of the two. "Fixed" panels remain in position when stowed or deployed by means of them being attached or hinged to the adjacent panel or panels. "Floating" panels are those that according to their shape have to be in one position when the armor is stowed as a shield, and have to be relocated when the armor is deployed as a vest. Floating panels either drop into place due to gravity when the shield is unstowed and being made ready to wear, or may be relocated by hand at that time. So that floating panels remain correctly located when stowed, they may be retained by means of a drawstring or other quick release mechanism. Similarly when deployed, floating panels may be guided to and held in the correct position by means of a drawstring or other quick fastening mechanism.

The individual armor panels are held together for use as a garment by means of a support system. The armor panels are incorporated into a vest-like garment, or attached (directly or indirectly) to attachments that deploy when the shield is unstowed and allow the armor panels to be worn as a vest. The support garment preferably comprises resilient fabric. The attachments preferably comprises fabric or elastic straps. In any case the purpose of the support system is to allow the quick and easy donning of the unstowed shield as a vest, and to position the armor against the body in a substantially fixed location.

The material and configuration of these attachments is such that the unstowed shield can be donned as a vest without the need for unfastening, fastening or adjustment, or such that the minimal procedure is required to don the vest and adjust to fit the body. The elastic straps used to secure the armor around the torso are preferably attached to or inserted within the vest so as to maximise the length of the elastic straps, and hence the length by which the elastic is able to extend. Consequently the vest can be pulled on over the head without having to unfasten and re-fasten the straps, and fitted to the body with little or no further adjustment. By this method the vest will also fit a greater range of body sizes without having to be unfastened, fastened or adjusted. The length of the elastic straps is maximized by either by using one or more complete loops or almost complete loops of elastic strap within the vest assembly, which encircle the torso and are either complete loops of elastic not anchored to the vest at any point, which may be described as "floating", or complete or almost complete loops of elastic only anchored at one or more points to prevent lateral movement of the elastic straps without decreasing the ability of the strap to extend.

The elastic straps are correctly positioned over the vest and the torso by being routed through the interior of the vest via slots or openings in the vest's outer cover. This method of concealing most of the elastic within the vest helps to avoid the incorrect placement or snagging of the straps when donning the vest as quickly as possible. Alternatively the "floating" or anchored elastic straps may be routed around the inner or outer surface of the vest's outer cover, through guides or attachments such as long tunnels or narrow belt loops similar to those on a pair of trousers. The straps, of course, may be of any width.

BRIEF DESCRIPTION OF THE DRAWINGS

Various other objects, advantages, and features of the invention will become apparent to those skilled in the art from the following discussion taken in conjunction with the following drawings, in which:

FIG. 1 is a perspective view of the preferred embodiment of the invention showing front, back, lower abdomen and side armor panels contained within an outer cover and the support system in the form of elastic straps.

FIG. 2 is a schematic view showing where the elastic straps are routed through the inside of the outer cover.

DETAILED DESCRIPTION OF THE PREFERRED EMBODIMENTS

Figure 3:
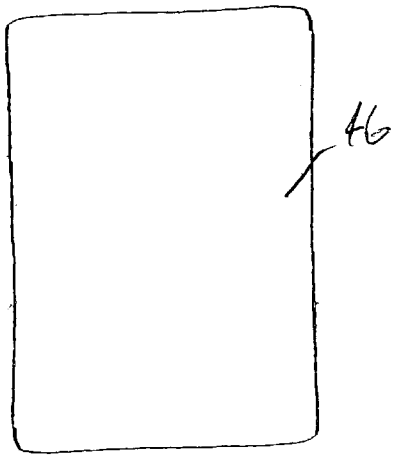
FIG. 3 is a plan view showing the lightweight semi-rigid outer casing of the invention when vacuum packed and in the mode of use as a shield.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like characteristics and features of the present invention shown in the various figures are designated by the same reference numerals.

FIG. 1 is a perspective view of the preferred embodiment of the invention in its use as a vest 10 ready to wear. It comprises an outer cover 12 within which are disposed a plurality of armor panels shown in phantom illustrating the position of the armor panels. Specifically included are front armor panel 14, rear armor panel 16, side armor panels 18 and 20, and lower abdomen armor panel 22. Also seen is the support system in the form of shoulder elastic straps 24 and 26 and waist elastic strap 28.

FIG. 2 is a schematic view showing where the elastic straps are routed through the inside of the outer cover 12. Waist elastic strap 28 is routed through the inside of the front 30 of outer cover 12 via slots 32 and 34, and through the inside of the back 36 of outer cover 12 via slots 38 and 40. The position of the waist elastic strap 28 concealed within the front 30 of the outer cover 12 is shown in phantom at 42 and the position of the waist elastic strap 28 concealed in the back 36 of the outer cover 12 is shown in phantom at 44. The waist elastic strap 28 forms a complete loop that is not anchored to the vest 10 at any point except that its position is maintained by the slots 32, 34, 38, and 40. There are two shoulder straps 24 and 26 illustrated as connected to the front 30 and back 36 outer cover over the user's shoulders.

FIG. 3 is a plan view showing the lightweight semi-rigid outer casing of the invention when vacuum packed and in the mode of use as a shield. Seen is the lightweight semi-rigid outer casing 46 that is intended to keep the component parts consolidated in the form of a flat shield.

Figure 4:
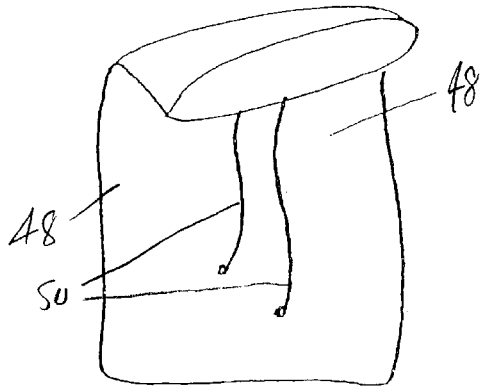
FIG. 4 is a perspective view of a flexible pouch closed with a draw string in which the folded invention may be stored and used as a shield as an alternative embodiment to that shown in FIG. 3. Also it may contain the entirety of FIG. 3 including the vacuum packed semi-rigid casing.

FIG. 4 is a perspective view of a f flexible pouch 48 that can be closed with a draw string 50 in which the folded invention may be stored and used as a shield as an alternative embodiment to that shown in FIG. 3. Also it may contain the entirety of figure 3 including the vacuum packed semi-rigid outer casing 46.

Figure 5:
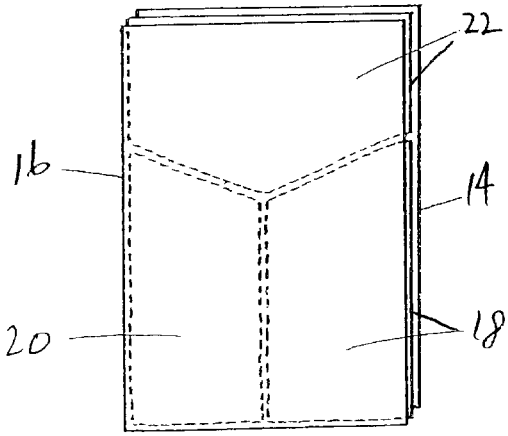
FIG. 5 is a plan view showing the location of the armor panels when stowed as a shield.

FIG. 5 is a plan view showing the location of the armor panels when stowed as a shield. The assembly comprises two main rectangular armor panels 14 and 16 and three smaller panels, 18, 20, and 22 shown in phantom and shaped so that when stowed as a shield the three smaller panels 18, 20, and 22 fit closely together and do not overlap, while at the same time the three collectively equal the same cross sectional area as the rectangular front 14 and rear 16 panels. That results in three layers, front panel 14, back panel 16, and the three smaller panels, 18, 20, and 22. When the invention is deployed and worn as a vest, as seen in FIG. 1, panel 14 protects the front of the torso, panel 16 protects the back of the torso, panels 18 and 20 protect the sides of the torso, and panel 22 protects the lower abdomen. For the purpose of illustration, the armor panels are shown but not the outer cover 12.

Figure 6:
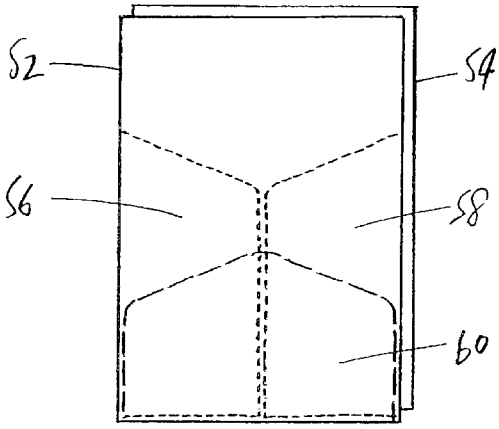
FIG. 6 is a plan view and shows how the outer cover is folded when stowed.

FIG. 6 is a plan view and illustrates how the outer cover is folded when stowed. It shows the outer cover 12 (within which the armor panels are carried, but not shown in this figure) that allows the assembly to be worn as a garment.

This fabric outer cover 12 comprises a front section 52 that carries the front armor panel 14 (not shown), connected by elastic straps, shown in FIGS. 1 and 2, to the back section 54 that carries the back armor panel 16 (not shown). Shown in phantom are the two side extensions 56 and 58 to the front section 52 which are folded within which carry side armor panels 18 and 20 (not shown). Also shown in phantom is lower extension 60 folded within that carries lower abdomen panel 22 (not shown). The elastic straps are also folded within the assembly but are not shown.

Figure 7:
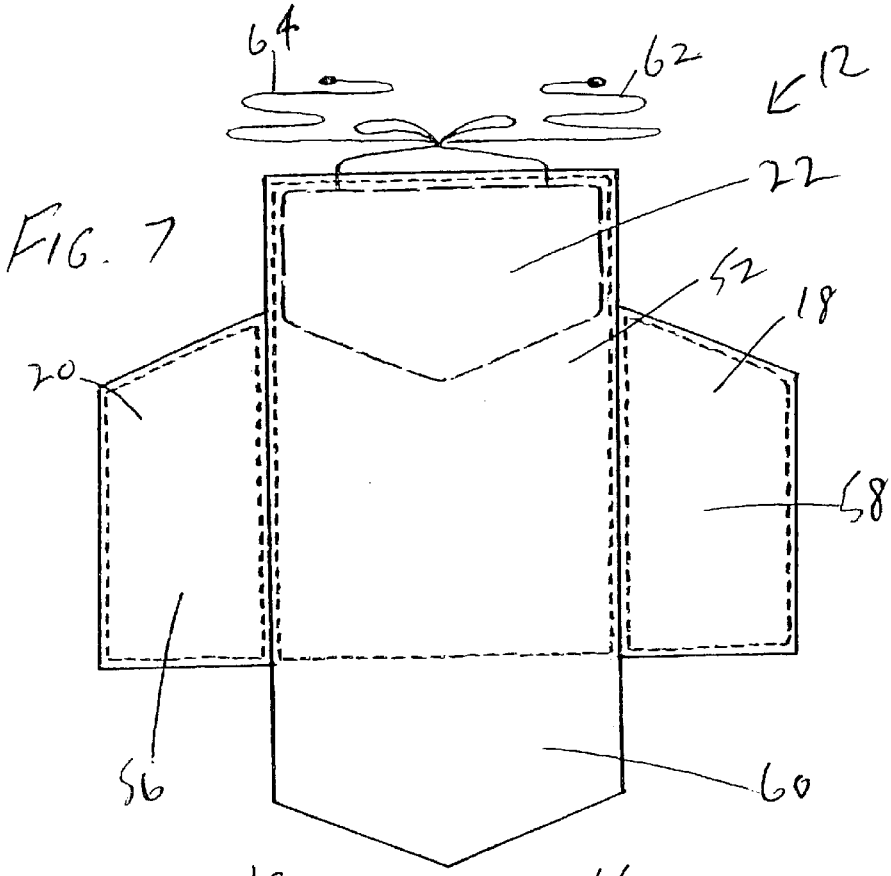
FIG. 7 is a plan view and shows the two side armor panels folded out, and lower extension of the outer cover unfolded.

FIG. 7 is a plan view and shows the two side armor panels folded out, and lower extension of the outer cover unfolded. Illustrated are the two side extensions 56 and 58 of the front section 52 of outer cover 12 fold outwards with the side armor panels 18 and 20 enclosed and shown in phantom. The lower extension 60 of outer cover 12 folds down as an empty receptacle ready to hold lower abdomen panel 22. The lower abdomen panel 22 is shown in phantom, still held in stowed position by quick-release drawstrings 62 and 64.

Figure 8:
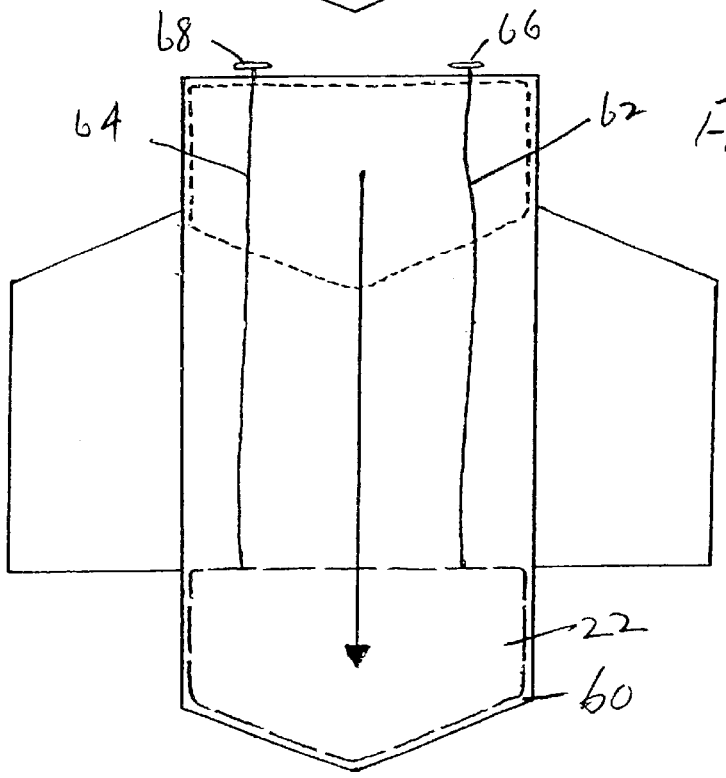
FIG. 8 is a plan view that shows how the lower abdomen panel is relocated to the lower extension of the outer cover.

FIG. 8 is a plan view that shows how the lower abdomen panel 22 is relocated to the lower extension 60 of the outer cover 12. It is dropped from the stowed position of FIG. 7 using the quick release drawstrings 62 and 64 so that it is disposed in the lower extension 60 of the outer cover 12, where it is seen in phantom. The ends of both drawstrings 62 and 64 have toggles 66 and 68 to prevent them being pulled into the outer cover 12, and can be pulled out again to relocate lower abdomen panel 22 to the stored position of FIG. 7. The extended drawstrings 62 and 64 are only just long enough to allow lower abdomen panel 22 to drop into the lower extension 60 disposed within outer cover 12. This ensures that the panel relocates correctly into the lower extension 60.

While the invention has been described, disclosed, illustrated and shown in various terms or certain embodiments or modifications which it has assumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

What is claimed is:

1. Dual use body armor comprising:

an outer cover;

a front, a rear and two side armor panels disposed within the outer cover to protect the front, rear and sides of a user's torso when deployed as a vest in a first use; and a support system for the vest;

wherein the body armor is foldable into a rectangular shape to serve as a hand held armor shield in a second use.

2. The body armor of claim 1 wherein the folding into a rectangular shape enables disguise of the armor shield by its disposition within an attache case.

3. The body armor of claim 1 wherein the armor shield is vacuum packed within a semi-rigid casing.

4. The body armor of claim 1 which further comprises a lower abdomen armor panel disposed within the outer cover to protect the lower abdomen of a user's torso.

5. The body armor of claim 1 wherein the support system is comprised of elastic straps.

6. The body armor of claim 5 in which the elastic straps include at least one complete loop encircling a waist of the user through slots in the outer cover but is not anchored to the body armor at any point.

7. The body armor of claim 6 which further comprises two shoulder straps fixedly connected to a front outer cover and a back outer cover over the user's shoulders without adjusting means, wherein the vest can be donned without any need for fastening or adjusting any elastic straps.

8. The body armor of claim 1 which further comprises disposed within the outer cover a front armor panel, a rear armor panel, two side armor panels and a lower abdomen armor panel wherein the side and lower abdomen armor panels are shaped so that they fit together as in a jigsaw puzzle, leaving minimal gaps between the panels when folded into the shield.

9. The body armor of claim 8 wherein the shield is comprised of three layers, one being the front armor panel, a second being formed of a jigsaw combination of two side armor panels and lower abdomen armor panel, and a third being formed of the rear armor panel.

10. The body armor of claim 9 wherein the armor shield is vacuum packed within a semi-rigid casing.

11. The body armor of claim 8 wherein the front, rear, and side armor panels are fixed in pockets disposed within the out or cover while the lower abdomen armor panel is moveable from a jigsaw puzzle position when stowed in a shield configuration, to a lower extension of the outer cover for deployment in a vest configuration.

12. The body armor of claim 11 which further comprises drawstrings to move the lower abdomen armor panel between the jigsaw puzzle position and the lower extension of the outer cover.

13. The body armor of claim 1 wherein conversion from use as a shield to use as a vest results in no superfluous parts remaining.

14. Dual use body armor comprising:

an outer cover;

a front armor panel, a rear armor panel, two side armor panels and a lower abdomen armor panel disposed within the outer cover to protect the front, rear, sides and lower abdomen of a user's torso when used as a vest in a first use; and a support system for the vest;

wherein the body armor is foldable into a rectangular shape of three layers to serve as a hand held armor shield in second use with the front and rear armor panels being outer layers and with the side and lower abdomen armor panels being shaped so that they fit together as a jigsaw puzzle, leaving minimal gaps between the panels as a middle layer when folded into the shield.

15. The body armor of claim 14 wherein the support system is comprised of elastic straps.

16. The body armor of claim 15 in which the elastic straps include at least one complete loop encircling a waist of the user through slots in the outer cover but is not anchored to the body armor at any point.

17. The body armor of claim 14 wherein the front, rear, and side armor panels are fixed in pockets disposed within the outer cover while the lower abdomen armor panel is moveable from a jigsaw puzzle position when stowed in a shield configuration, to a lower extension of the outer cover for deployment in a vest configuration.

18. The body armor of claim 17 which further comprises drawstrings to move the lower abdomen armor panel between the jigsaw puzzle position and the lower extension of the outer cover.

19. Dual use body armor comprising:

an outer cover;

at least one armor panel disposed within the outer cover to protect the front of a user's torso when deployed as a vest in a first use; and a support system of elastic straps for the vest, the elastic straps including at least one complete loop encircling a waist of the user through slots in the outer cover but the loop is not anchored to the body armor at any point;

wherein the body armor is foldable into a rectangular shape to serve as a hand held armor shield in a second use.

* * * * *